US006761592B2

(12) United States Patent
Wu

(10) Patent No.: US 6,761,592 B2
(45) Date of Patent: Jul. 13, 2004

(54) POWER ADAPTER FOR INTERCONNECTING DIFFERENT TYPES OF POWER CONNECTORS

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/269,207

(22) Filed: Oct. 11, 2002

(65) Prior Publication Data

US 2004/0072471 A1 Apr. 15, 2004

(51) Int. Cl.[7] ..... H01R 25/00; H01R 27/02; H01R 31/00

(52) U.S. Cl. ..... 439/638; 439/732; 439/904

(58) Field of Search ..... 439/731, 904, 439/638, 675, 732

(56) References Cited

U.S. PATENT DOCUMENTS 6,450,829 B1 * 9/2002 Weisz-Margulescu ..... 439/352

2003/0008565 A1 * 1/2003 Chang ..... 439/638

* cited by examiner

*Primary Examiner*—Hae Moon Hyeon

(74) *Attorney, Agent, or Firm*—Wei Te Chung

(57) ABSTRACT

A power adapter (10) includes a first power connector (20) and a second power connector (30). The first power connector comprises a first housing (21) and a first contact module (22) consisted of a plurality of first contact units (40) assembled in the first housing. The second power connector comprises a second housing (50) and a polarity of second contacts (52). Each of the second contact is aligned and cooperated with a corresponding first contact unit of the first contact module to form a transmission path. A plurality of latch devices is provided on each opposite end of the first housing and the second housing for fastening each other. The power adapter is designed to connect a Serial ATA power connector with a Non-serial ATA connector.

15 Claims, 10 Drawing Sheets

POWER ADAPTER FOR INTERCONNECTING DIFFERENT TYPES OF POWER CONNECTORS

CROSS-REFERENCE TO RELATED APPLICATION

This patent application is a co-pending application of U.S. patent application Ser. No. 10/211464, entitled "ELECTRICAL ADAPTER", filed on Aug. 1, 2002; of an application entitled "ADAPTER FOR POWER CONNECTOR"; and another application entitled "ELECTRICAL ADAPTER", all invented by the same inventor and assigned to the same assignee as the present application.

BACKGROUND OF THE INVENTION

1. Field of the Invention

The present invention relates to a power adapter, and particularly to a power adapter which interconnects different types of power connectors so as to provide a power transmission therebetween.

2. Description of Related Art

The design of a mother board is repeatedly upgraded for complying with an issuance of each new electrical member to be mounted thereon. Some peripheral electrical devices such as a power supply and the related power connector must also be adapted to accommodate the new type of printed circuit board. Therefore, various different interface standard power connectors are continually proposed to be applied in a computer interior structure. However, such power connectors according different interface standard are generally featured in different configurations and each has different numbers electrical contacts therein. Understandably, such different interface standard power connectors cannot mate directly. Many electrical adapters, thereby, are designed to interconnect those different interface standard connectors.

Generally, the electrical adapter electrically interconnecting with different interface standard connectors performs the functions of signal/power transmission and conversion therebetween by two ways. If the numbers of electrical contacts of the different interface connector are equal, the adapter may mechanically and electrically connect corresponding contacts directly. In the other hand, the adapter need comprise a printed circuit board thereof which can perform the functions of signal/power transmission and conversion if the numbers of the different standard connectors are different. Obviously, the adapter having a printed circuit board would add expense relative to the adapter directly interconnecting the different interface standard.

There also exists in the art an electrical connector known as a Serial Advanced Technology Attachment (Serial ATA) connector which is generally used for disk drives and storage peripherals connecting with the mother board. It should be noted that the Serial ATA power connectors according the Serial ATA standard are in added power contacts than other conventional power connectors used in Integrated Drive Electronics (IDE) and are relatively different in configurations. Correspondingly, the present problem people in the art confronts, is that a storage peripheral using a Serial ATA power connector may be required to connect with an existing mother board which originally uses a conventional IDE power connector to connect with the storage peripheral, for the speed or other considerations. Under this situation, it is not convenient to wholly replace the system, which adds cost. Accordingly, a power adapter interconnecting the Serial ATA power connector and the conventional IDE power connector is desired. Furthermore, the power adapter without printed circuit board is required to save cost.

Hence, a power adapter for interconnecting the power connectors of different interface standard is required to overcome the disadvantages of the related art.

SUMMARY OF THE INVENTION

Accordingly, a first object of the present invention is to provide a power adapter for electrically interconnecting a Serial ATA power connector and a conventional IDE power connector.

A second object of the present invention is to provide a power adapter which can perform the functions of power transmission and conversion without printed circuit board.

In order to achieve the objects set forth, a power adapter in accordance with the present invention includes a first power connector according Serial Advanced Technology Attachment (Serial ATA) Standard and a second power connector which is a generally conventional IDE power connector. The first power connector comprises a first housing and a first contact module consisted of a plurality of first contact units assembled in the first housing. The second power connector comprises a second housing and a plurality of second contacts mounted in the second housing. Each of the second contact is aligned and cooperated with a corresponding first contact unit of the first contact module to form a transmission path. A plurality of latch devices is provided on each opposite end of the first housing and the second housing for fastening each other. The power adapter is designed to connect a Serial ATA power connector with a conventional IDE power connector.

Other objects, advantages and novel features of the invention will become more apparent from the following detailed description when taken in conjunction with the accompanying drawings.

BRIEF DESCRIPTION OF TIE DRAWINGS

DETAILED DESCRIPTION OF THE INVENTION

Figure 1:
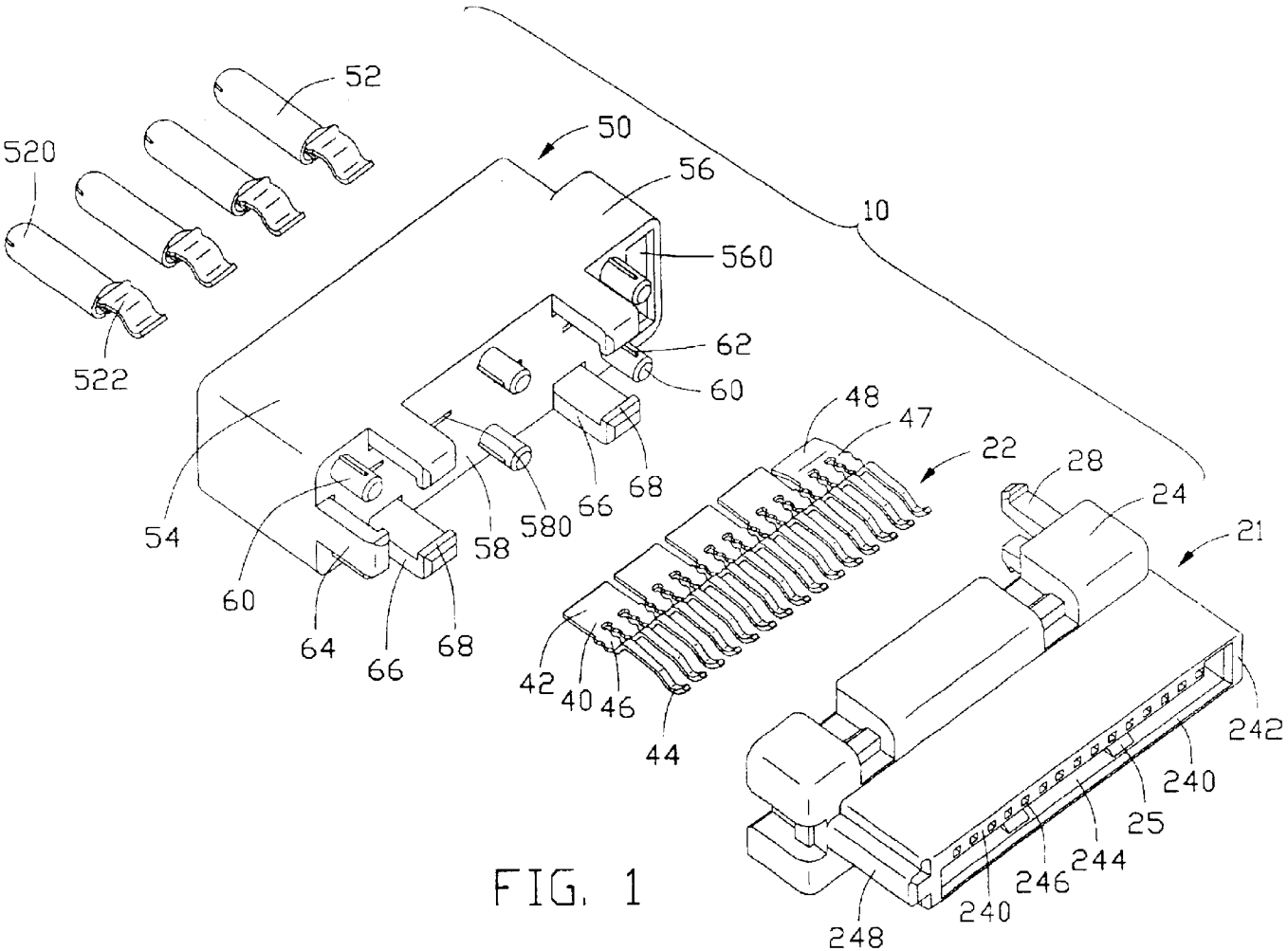
FIG. 1 is an exploded, perspective view of a power adapter in accordance with the present invention.
Figure 2:
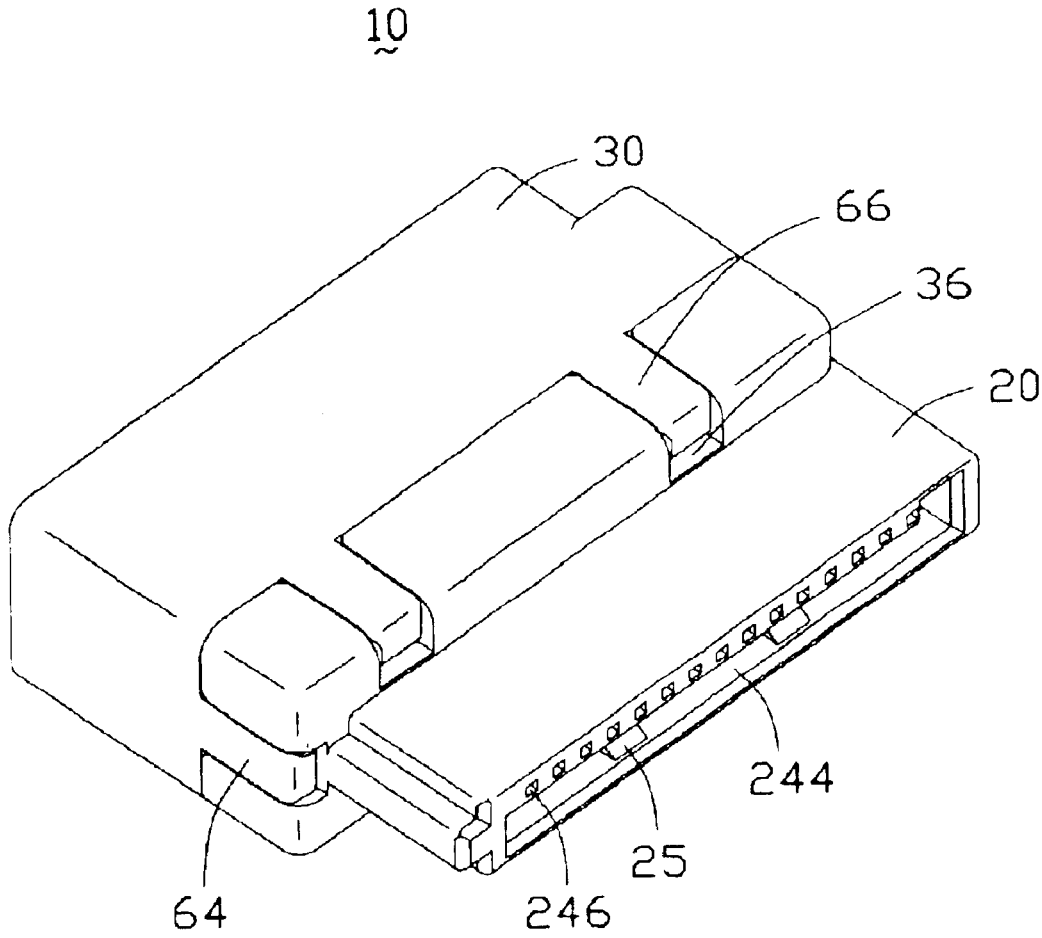
FIG. 2 is an assembled perspective view of the power adapter of FIG. 1.

Referring to FIGS. 1–2, a power adapter 10 in accordance with the present invention comprises a first power connector 20 and a second power connector 30. In the preferred embodiment, the first power connector 20 is a Serial Advanced Technology Attachment (Serial ATA) power receptacle connector and the second power connector 30 is a conventional IDE plug power connector. The power adapter 10 is designed to connect a corresponding Serial ATA power plug connector and a conventional IDE power receptacle connector, which are not shown in the drawings, thereby providing a power transmission therebetween.

Also referring to FIG. 1, the first power connector 20 comprises a first housing 21 generally molded of dielectric materials such as plastic or the like, and a first contact module 22. The first housing 21 has an elongate first base 24 from which a pair of longitudinal sidewalls 240 and a pair of lateral ends 242 connecting opposite ends of the longitudinal sidewalls 240 forwardly extends. The longitudinal sidewalls 240 and the lateral ends 242 together define an L-shaped receiving slot 244 therebetween for receiving a corresponding blade of the complementary Serial ATA plug connector. One of longitudinal sidewalls 240 is thicker than the other of the longitudinal sidewalls 240 and defines a plurality of first passageways 246 communicating with the receiving slot 244. A pair of protrusions 25 projects from an inner wall of the other longitudinal sidewall 240 into the L-shaped receiving slot 244. The pair of protrusions 25 is designed for being retained in corresponding channels (not shown) defined in the blade of the complementary Serial ATA plug connector. The pair of lateral ends 242 includes a left lateral end 242 and a right lateral end 242. An alignment portion 248 is disposed adjacent the left lateral end 242 of the housing 21.

Figure 3:
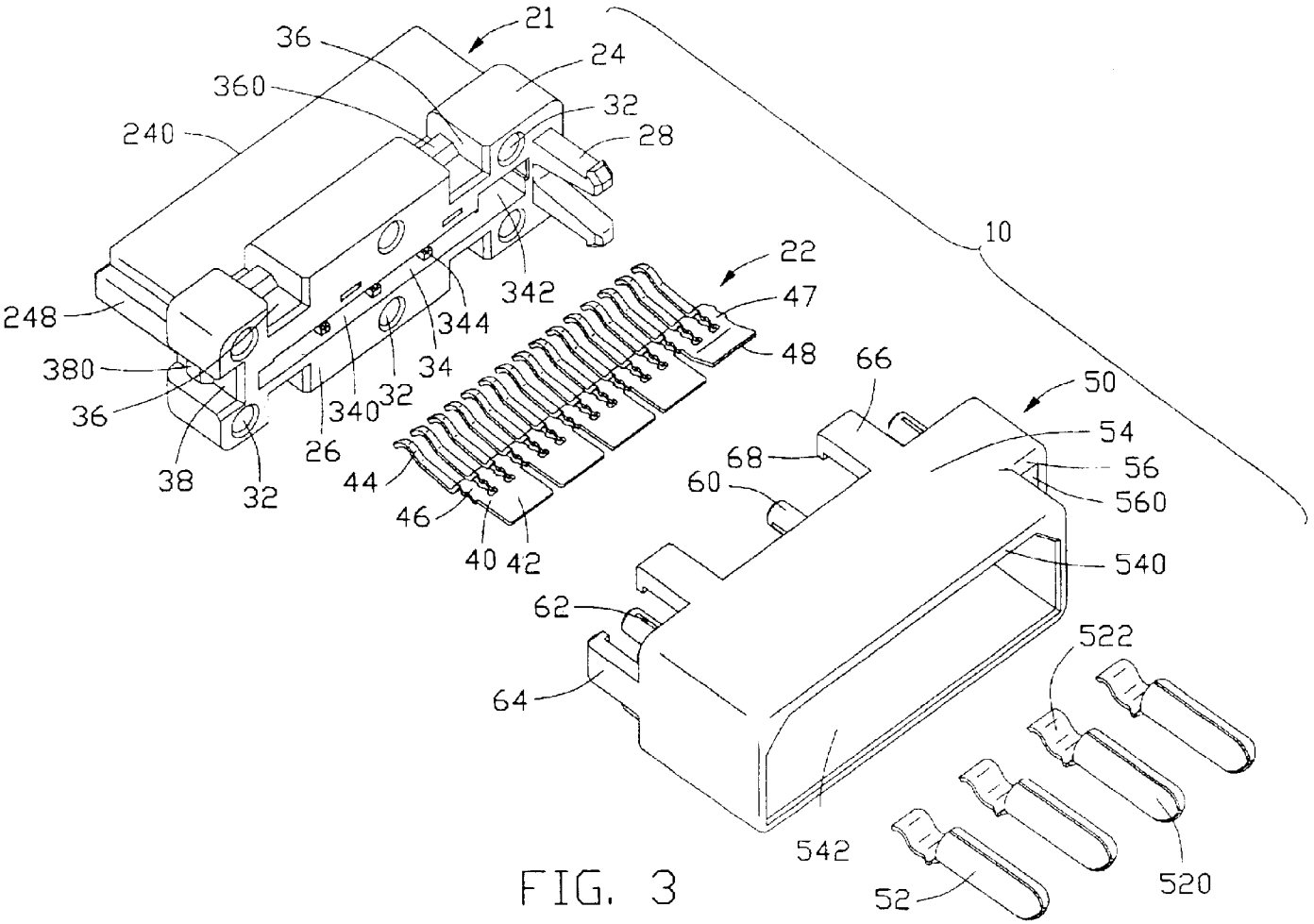
FIG. 3 is a view similar to FIG. 1, but taken from rear and bottom aspects.
Figure 4:
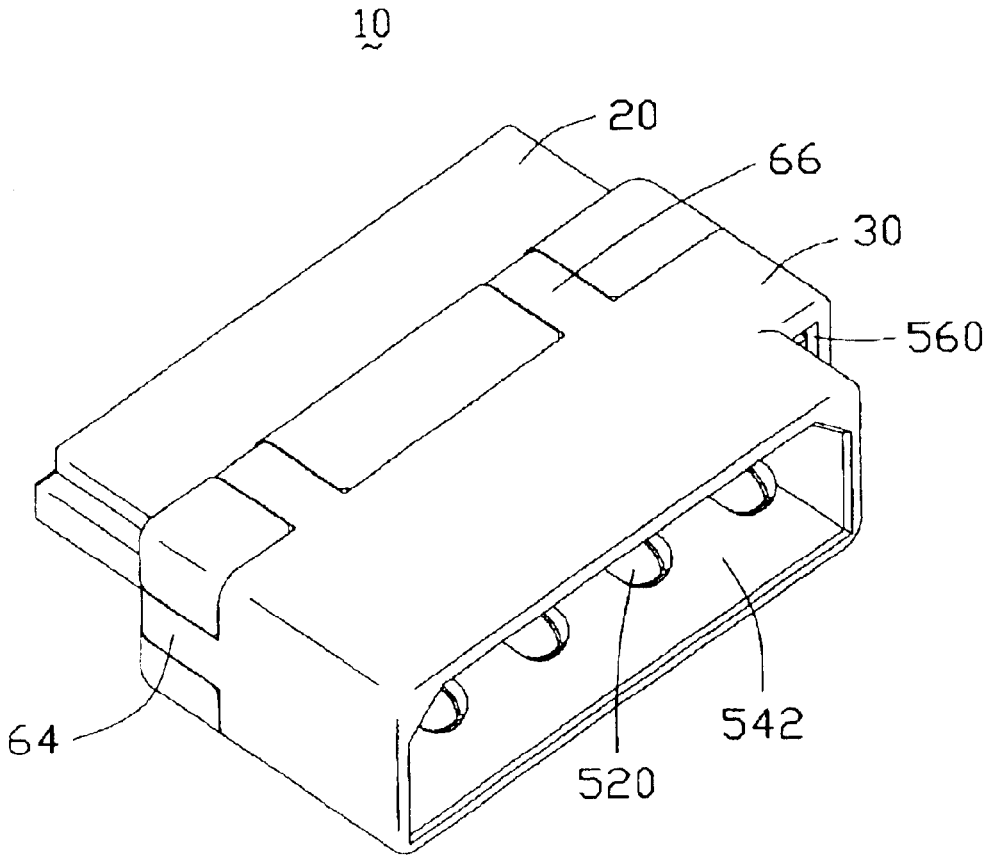
FIG. 4 is a view similar to FIG. 2, but taken from a rear aspect.

The first base 24 of the first housing 21 further has a first abutment surface 26, as best shown in FIG. 3. A pair of resilient latches 28 extends backward away from the first abutment surface 26 and is aligned with the right lateral end 242 of the first housing 21. The pair of resilient latches 28 is spaced for receivably engagement with a corresponding right channel 560 of the second power connector 30. Three pairs of polarization holes 32 extend inward from the abutment surface 26 for receiving corresponding polarization posts 60 of the second power connector 30. The first base 24 further defines a L-shaped rear slot 34 communicating with the passageways 246. The rear slot 34 has a left part 340 and a right part 342 communicating with each other. In the embodiment, the right part 342 of the rear slot 34 has an altitude dimension larger than the left part 340 for purpose described hereinafter. Correspondingly, the first base 24 forms an oblique face 346 facing the right part 342 (best shown in FIG. 9). A plurality of opposite bars 344 projects into the rear slot 34, whereby corresponding separate first contact units 40 of the first contact module 22 may be respectively restrained by corresponding opposite bars 344 along its lengthwise direction.

The first base 24 has two middle channels 36 defined on each longitudinal sides thereof and a left channel 38 defined in the lateral ends thereof and corresponding to the alignment portion 248 of the housing 21. Each of the middle channels 36 and side channel 38 is adapted for retaining a corresponding latches 64, 66 of the second power connector 30 with a step portion 360 (380) formed at the bottom thereof engaging with a corresponding hook 68 of each of the latches 64, 66.

Referring to FIG. 1 and FIG. 3, the first contact module 22 has a plurality of first contact units 40. Each first contact unit 40 comprises a body portion 42, a plurality of tail portions 44, a plurality of retaining portions 46 extending from an edge of the body 42 and each connecting with a corresponding tail portion 44. The body portion 42 is flat, rectangular shaped It should be noted that the contact module 22 comprises a submarginal first contact unit 47, which has a body portion 48 bending upwardly, and inclining a certain degree relative to corresponding retaining portions 46 thereof In other words, the body portion 48 of the submarginal first contact unit 47 inclines a degree relative to other body portions 42 of the other first contact unit 40.

In assembly, the first contact module 22 are inserted into the rear slot 34 from the first abutment surface 26 of the housing 21. Referring FIGS. 1, 3 in conjunction FIG. 7, each tail portion 44 of the first contact module 22 is received into a corresponding first passageway 246 and partially projects into the receiving slot 244 adapted for mate with a corresponding contact of the complementary Serial ATA plug connector. Each body portion 42 is retained in the rear slot 34 with the edges thereof engaging with corresponding opposite bars 344 and corresponding side inner walls of the housing 21.

Figure 9:
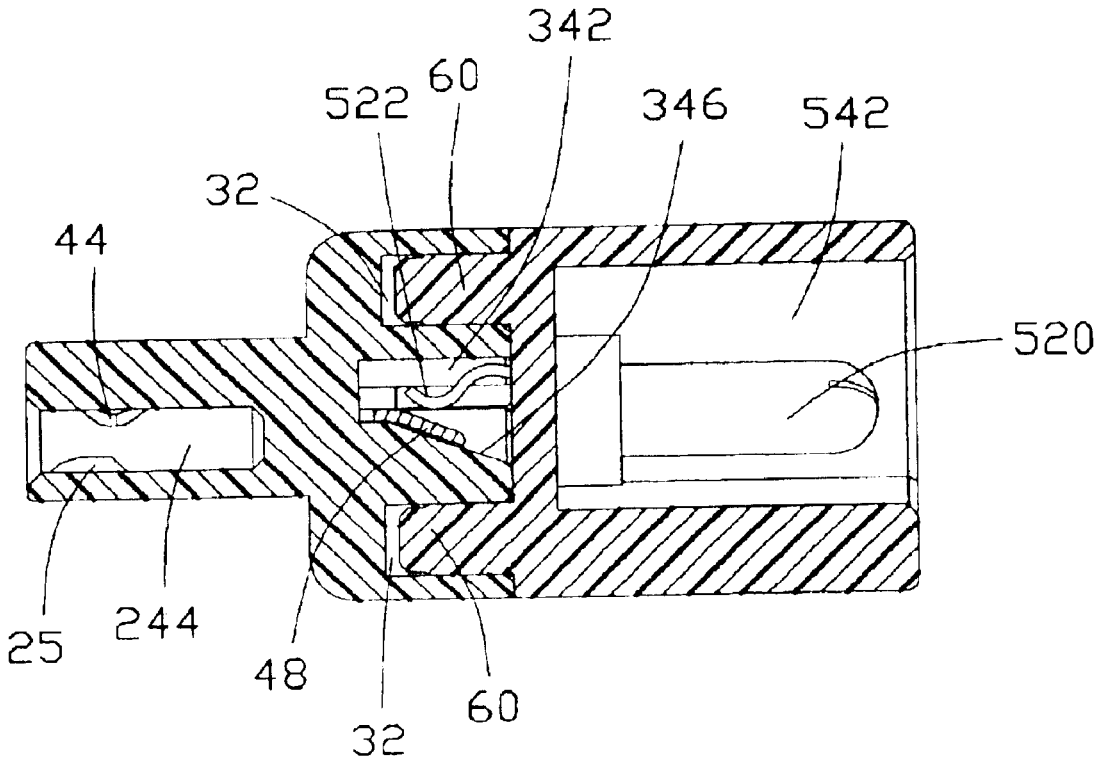
FIG. 9 is a cross-sectional view taken along section line 9—9 of FIG. 6.

Understandably, since the submarginal first contact unit 47 of the first contact module 22 has an inclined body portion 48 bending upwardly, the submarginal first contact unit 47 is correspondingly inserted in the right part 342 of the rear slot 34 with the body portion 48 adjacent to the oblique face 346 thereof for the right part 342 has an altitude dimension larger than the left part 340, best shown in FIG. 9.

The second power connector 30, as shown in FIG. 1 and FIG. 3, comprises a second housing 50 and a plurality of second contacts 52 which are power contacts. The housing 50 includes a second base 54 having a forwardly projecting shroud 540 defining a receiving cavity 542 therein. A side protrusion 56 is disposed at one of longitudinal ends of the second base 54. The side protrusion 56 defines a right channel 560 therein for receiving the pair of first resilient latches 28 of the first power connector 20.

The second base 54 of the housing 50 fixer has a second abutment surface 58. A plurality of second passageways 580 extends from the second abutment surface 58 through the second base 54 and communicates the receiving cavity 542 for retaining corresponding second contacts 52 therein. Three pairs of polarization posts 60 project beyond the second abutment surface 58 for respectively being received into corresponding polarization holes 32 of the first connector 20. Each polarization post 60 has a plurality of ribs 62 protruding therefrom.

A left latch 64 and two pairs of middle latches 66 respectively project beyond the second abutment surface 58 of the second base 54. Each of the latches 64, 66 defines a hook 68 at front end thereof for snugly engaging with a corresponding step portion 360 of the channels 36 of the first power connector 20.

Figure 5:
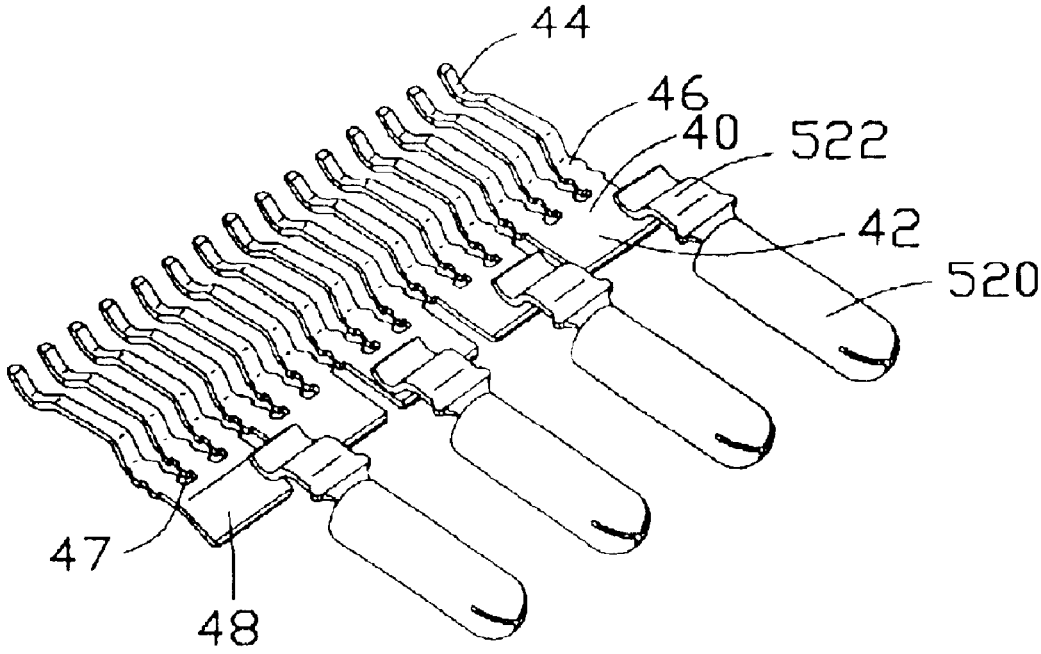
FIG. 5 is a perspective view showing a contact modules of a first power connector mating with corresponding second contacts of a second power connector of the power adapter of FIG. 1.
Figure 6:
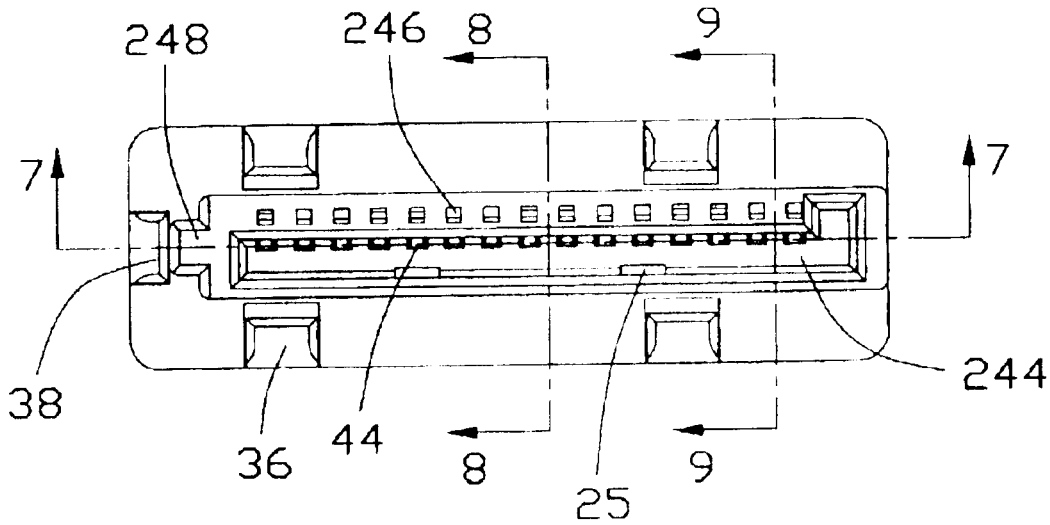
FIG. 6 is a front plan view of the power adapter of FIG. 1.

The second contacts 52 are stamped and formed from a flat metal sheet into the shape as shown. Referring to FIG. 1 and FIG. 3 in conjunction with FIG. 5, each second contact 52 has a substantially cylindrical shape and comprises a contact portion 520 at a front end thereof and a flange-shaped mounting portion 522 at a rear end thereof. The second contacts 52 are inserted into the receiving cavity 542 of the housing 50 with the mounting portions 522 thereof retained in corresponding second passageways 580 and extending outwardly beyond the second abutment surface 58 for mating with corresponding body portions 48 of the first contact modules 22 of the first power connector 20. The contact portion 520 thereof is exposed in the receiving cavity 542 adapted for mating with a corresponding contact (not shown) of the complementary IDE power receptacle connector.

Referring particularly to FIGS. 1, 3, 7 and 8, in assembly, the second abutment surface 58 of the second power connector 30 confronts the first abutment surface 26 of the first power connector 20. Each mounting portion 522 of the second contacts 52 abuts a corresponding body portion 42, of the first contact modules 22 for providing power transmission therebetween except the submarginal second contact 52. The left latch 64 and the pairs of middle latches 66 of the second power connector 30 are respectively retained in corresponding channels 36 of the first power connector 20 with the hooks 68 thereof engaging with corresponding step portions 360 thereof. Simultaneously, the polarization posts 60 of the second power connector 30 are snugly received within the corresponding polarization holes 32 of the first power connector 20 with the ribs 62 thereof engaging with the first housing 21 for avoiding reverse assembling along the lengthwise direction of the first housing 21 and the second housing 50. The first power connector 20 and the second power connector 30 are thus fastened with each other. Therefore, a power adapter 10 for interconnecting different interface standard power connectors on opposite ends thereof is thus accomplished.

Figure 7:
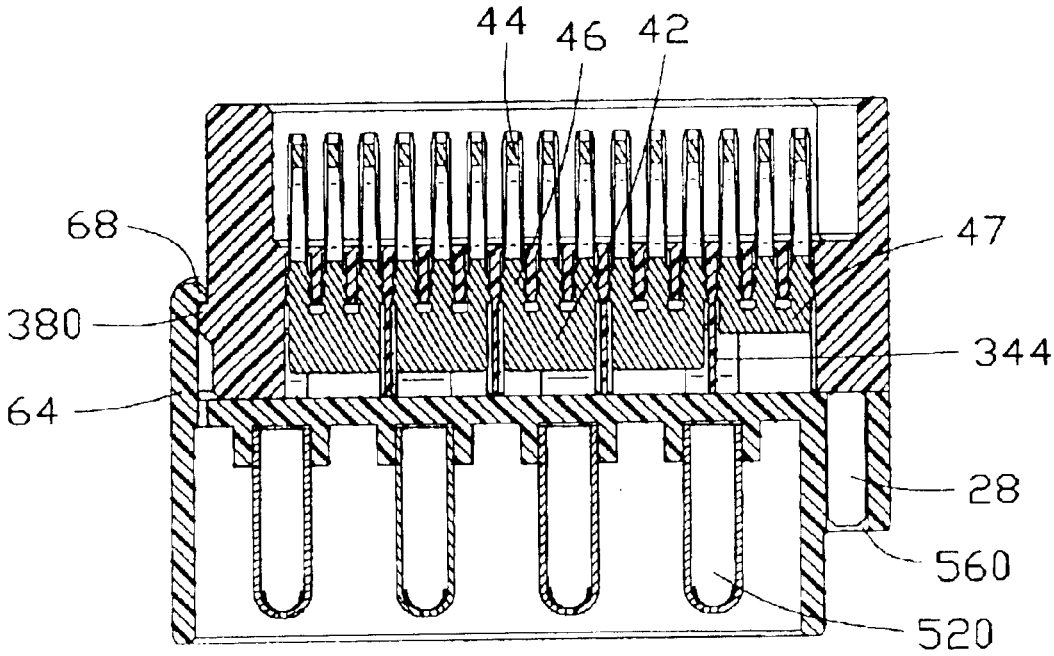
FIG. 7 is a cross-sectional view taken along section line 7—7 of FIG. 6.
Figure 8:
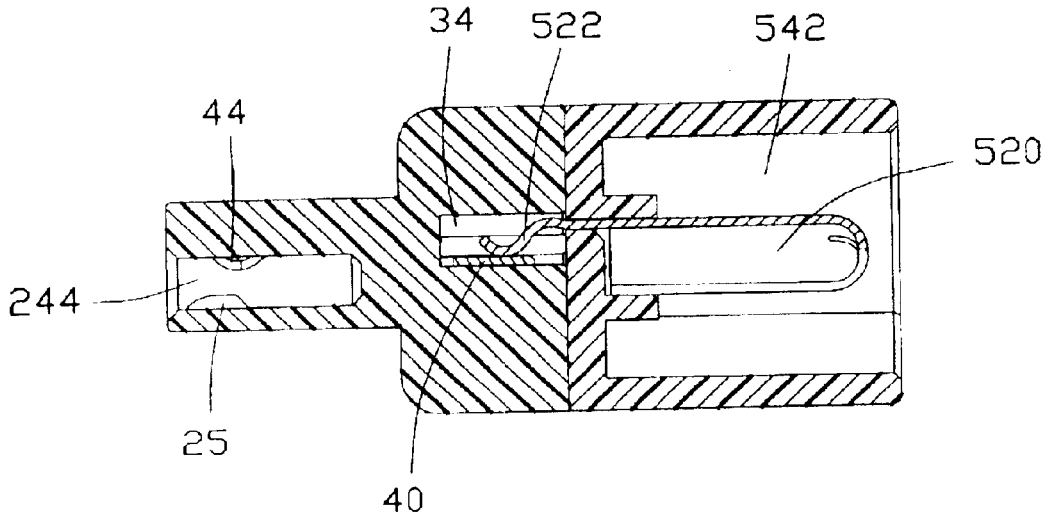
FIG. 8 is a cross-sectional view taken along section line 8—8 of FIG. 6.

Referring to FIG. 9 in conjunction with FIG. 7, it should be noted that in the preferred embodiment the submarginal first contact unit 47 of the first power connector 20 disconnects corresponding submarginal second contact 52 of the second connector 30 by means that the body portion 48, thereof inclines a certain angle relative to other body portions 42.

Figure 10:
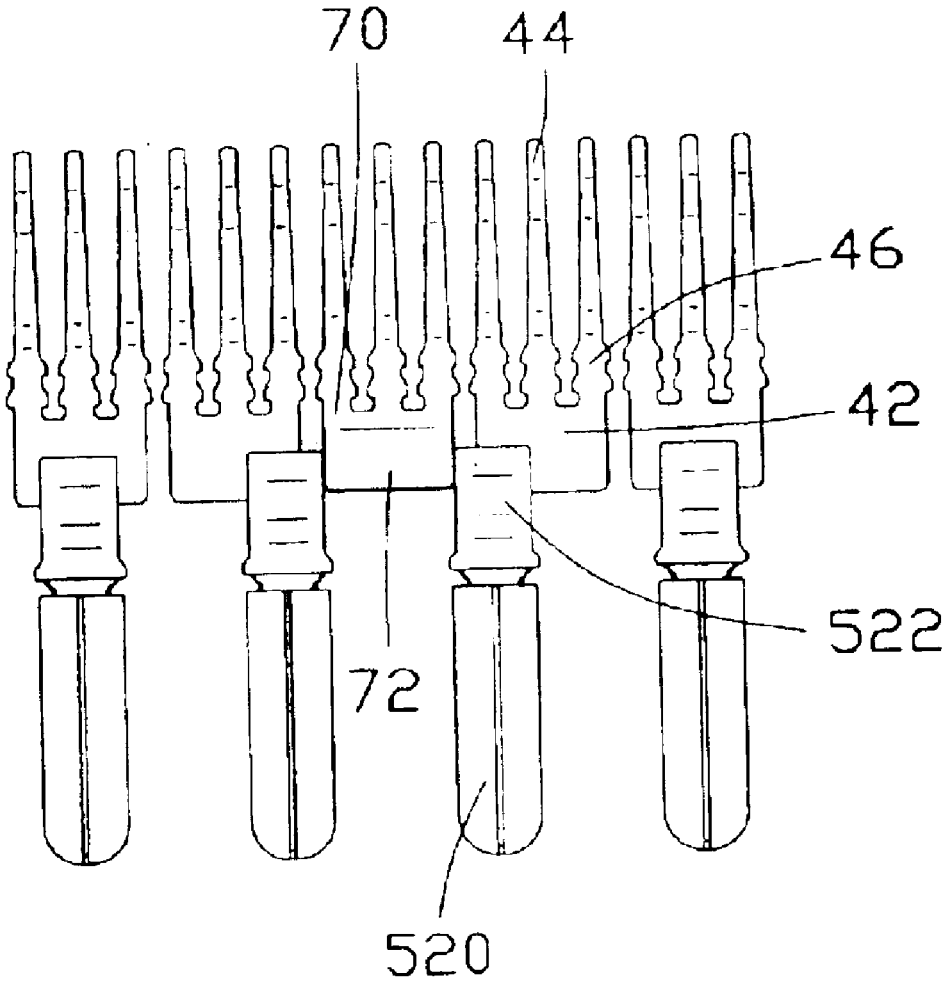
FIG. 10 is a top planar view showing a contact modules of a first power connector mating with corresponding second contacts of a second power connector of a power adapter according to a second embodiment of the present invention.

Although the submarginal first contact unit 47 of the adapter 10 is described in the preferred embodiment, it should be appreciated that any second contact 52 can disconnect with a corresponding first contact unit 40 for the power transmission consideration. FIG. 10 shows that one of middle first contact unit 70 thereof disconnects a corresponding second contact 52. Of course, it's also feasible that the first contact units 40 of the first power connector 20 all mates corresponding second contact 52 of the second power connector 30.

The power adapter 16 in accordance with the present invention can electrically interconnects with different interface standard power connectors, such as a Serial ATA power plug connector and a conventional IDE power connector. The power connectors of different interface standard can be applied in a system, thus, the system need not be wholly replaced and the cost will be saved accordingly. Furthermore, the power adapter 10 interconnects directly two different power connectors having different numbers of electrical contacts and performs the functions of power transmission and conversion without printed circuit board. The manufacture of the power adapter 10 is cheaper and simple.

Finally, it should be understood that the use of such terms "upper", "lower", "top", "bottom", "submarginal" and the like, herein and in the claims hereof, are used to provide a clear and concise description and understanding of the invention. Such terms are not meant in any way to be limiting, because the adapter power structural combination of the invention is omni-directional in use as is easily understandable.

One feature of the invention is to provide a contact structure arrangement which allows first and second type contacts with different pitches to interconnect with each other without necessity of varying each individual configuration for compensating the pitch difference, under a condition that in one pair of mated first and second contacts, the mated region relative to the corresponding first contact is different, in a lateral direction, from that relative to another corresponding first contact in another pair.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power adapter comprising:

a Serial Advanced Technology Attachment (Serial ATA) power connector, comprising a first housing and a first contact module consisted of a plurality of first contact units and assembled in the first housing, the first housing having a first base and a pair of sidewalls extending forwardly from the first base, the sidewalls defining an L-shape receiving slot therebetween, the first base defining a rear slot corresponding to the receiving slot, one of the longitudinal sidewall defining a plurality of passageways communicating the receiving slot and the rear slot, the rear slot having a left part and a right part communicating with each other and the right part having an altitude dimension larger than the left part, the first contact module comprising a submarginal first contact unit having a body portion bending upwardly and received in the right part of the rear slot; and a conventional IDE power connector comprising a second housing interconnected with the first housing and a plurality of second power contacts assembled in the second housing;

wherein the second power contacts are respectively cooperated with corresponding first contact units for providing power transmission therebetween.

2. The power adapter as claimed in claim 1, wherein each first contact unit of the first connector comprises a body portion remained in the rear slot, a plurality of tail portions projecting into the receiving slot, and a plurality of retaining portions extending from an edge of the body portion and each connecting with a corresponding tail portion.

3. The power adapter as claimed in claim 2, wherein an upper and a lower innerwalls of the rear slot of the Serial ATA power connector defines a plurality of bars projecting into the rear slot, every two adjacent bars defining a channel for receiving a corresponding body portion of the first contact module.

4. The power adapter as claimed in claim 2, wherein the second housing of the conventional IDE power connector comprises a second base having a forwardly projecting shroud defining a receiving cavity, the second base defines a plurality of second passageways communicating with the receiving cavity.

5. The power adapter as claimed in claim 4, wherein each second contact of the second connector comprises a contact portion at a front end thereof and a mounting portion at a rear end thereof, the mounting portion retained in the second passageway and extending beyond the second base and electrically abutting against a corresponding body portion of the first contact unit of the Serial ATA power connector.

6. The power adapter as claimed in claim 5, wherein the contact portion of the second contact has a substantially cylindrical shape, and the mounting portion thereof is a flange-shaped.

7. The power adapter as claimed in claim 1, wherein the first base of the Serial ATA power connector has a first abutment surface, and the second base of the conventional IDE power connector has a second abutment surface confronting the first abutment surface.

8. The power adapter as claimed in claim 7, wherein the first base defines a plurality of polarization holes extending inwardly from the first abutment surface, and the second base defines a corresponding number of polarization posts snugly received within the corresponding polarization holes.

9. The power adapter as claimed in claim 7, wherein the first base defines two middle channels in an upper and lower surface thereof and a step portion formed at the bottom of each middle channel, and the second base comprises two pairs of middle latches received in the corresponding middle channels and engaging with the corresponding step portions of the first base.

10. The power adapter as claimed in claim 7, wherein the first base further defines a left channel at the lateral end thereof and a step portion formed at the bottom of the left channel, and the second base comprises a left latch received in the left channel and engaging with the step portion thereof.

11. The power adapter as claimed in claim 7, wherein the first base further defines a pair of resilient latches extending rearward from the first abutment surface, the second housing comprises a side protrusion defining a right channel therein for receiving the pair of resilient latches therein.

12. The power adapter as claimed in claim 1, wherein a centerline of a mating port of said Serial ATA power connector and that of another mating port of said IDE power connector are offset from each other.

13. A power adapter, comprising:

a first power connector comprising a first housing having a first abutment surface at a rear end thereof and a first contact module having a plurality of first contact unit, the first housing defining a plurality of passageways at a front end, and a rear slot defined from the first abutment surface and communicating with the passageways, each first contact unit having a body potion remained in the rear slot and a plurality tail portions extending forwardly from an edge of the body portion and received in a corresponding passageway;

a second power connector comprising a second housing and a plurality of second contacts, the second housing having a second base having a second abutment surface and a forwardly projecting shroud defining a receiving cavity therein, the second base defining a plurality of second passageways extending from the second abutment surface through the second base and communicating with the receiving cavity, each second contact comprising a contact portion projecting into the receiving cavity and a mounting portion retained in a corresponding second passageway and extending outwardly beyond the second abutment surface; wherein the first connector and the second connector are fastened with each other in a back-to-back manner, the first abutment surface of the first housing confronts the second abutment surface of the second housing, and the mounting portions of the second contacts mate with corresponding body portions of the first contact modules, and wherein the first contact module has submarginal first contact unit which has a body portion inclined an angle relative to other body portions, the second contact corresponding to the submarginal first contact unit disconnecting the submarginal first contact unit.

14. A power adaptor comprising:

different first and second connectors substantially back to back assembled to each other, said first connector including a first housing with a plurality of first contacts (44) therein and a fist mating port thereof for coupling with a complementary first connector, said second connector including a second housing with a plurality of second contacts (52) therein and a second mating port thereof for coupling with a complementary second connector different from said first complementary connector, some of said first contacts (44) being grouped with plural sets (40) in compliant contact with a number of the second contacts (52) along a front-to-back direction; wherein a pitch of said plural sets (40) of first contacts (44) is different from that of said second contacts (52); wherein each of said plural sets (40) of first contacts (44) engages the corresponding second contact (52) at one specific relative position thereof, which is different from another specific relative position of another of said plural sets (40) of first contacts (44) where another corresponding second contact (52) engages, so as to allow the sets (40) of first contacts (44) and the second contacts (52), with pitches different from each other, to be interconnected with each other without varying configurations of said sets (40) of first contacts (44) and those of said second contacts (52) individually for compensating pitch difference.

15. The adaptor as claimed in claim 14, wherein the rest of said first contacts is grouped as at least one additional set, and said least one additional set has a different configuration from those of said plural sets so as to avoid engaging the adjacent second contact and be a dummy one for coupling to the complementary first connector while not interconnecting with the second connector.

* * * * *